US006116926A

United States Patent [19]

Ortega et al.

[11] Patent Number: 6,116,926

[45] Date of Patent: Sep. 12, 2000

[54] CONNECTOR FOR ELECTRICAL ISOLATION IN A CONDENSED AREA

[75] Inventors: Jose L. Ortega, Camp Hill; Stuart Craig Stoner, Lewisberry, both of Pa.

[73] Assignee: BERG Technology, Inc., Reno, Nev.

[21] Appl. No.: 09/295,504

[22] Filed: Apr. 21, 1999

[51] Int. Cl.[7] ..... H01R 4/66; H01R 13/648

[52] U.S. Cl. ..... 439/108; 439/608; 439/857

[58] Field of Search ..... 439/92, 108, 608, 439/748, 857, 856, 101, 862

[56] References Cited

U.S. PATENT DOCUMENTS

| | | | |
|---|---|---|---|
| Re. 32,691 | 6/1988 | Dola et al. | 439/608 |
| 3,871,728 | 3/1975 | Goodman . | |
| 4,686,607 | 8/1987 | Johnson | 361/413 |
| 4,846,727 | 7/1989 | Glover et al. | 439/608 |
| 4,898,546 | 2/1990 | Elco et al. | 439/608 |
| 4,914,062 | 4/1990 | Voltz | 439/608 |
| 4,973,273 | 11/1990 | DePriest | 439/856 |
| 4,975,084 | 12/1990 | Fedder et al. | 439/608 |
| 5,055,069 | 10/1991 | Townsend et al. | 439/608 |
| 5,080,613 | 1/1992 | Orui et al. | 439/660 |
| 5,104,341 | 4/1992 | Gilissen et al. | 439/608 |
| 5,133,679 | 7/1992 | Fusselman et al. | 439/608 |
| 5,135,405 | 8/1992 | Fusselman et al. | 439/108 |
| 5,141,453 | 8/1992 | Fusselman et al. | 439/608 |
| 5,151,036 | 9/1992 | Fusselman et al. | 439/108 |
| 5,174,770 | 12/1992 | Sasaki et al | 439/108 |
| 5,197,893 | 3/1993 | Morlion et al. | 439/101 |
| 5,238,414 | 8/1993 | Yaegashi et al. | 439/108 |
| 5,292,256 | 3/1994 | Brunker et al. | 439/108 |
| 5,310,354 | 5/1994 | OSwald, Jr. | 439/108 |
| 5,370,549 | 12/1994 | Lee | 439/342 |
| 5,403,206 | 4/1995 | McNamara et al. | 439/608 |
| 5,421,735 | 6/1995 | Dechelette | 439/101 |
| 5,484,310 | 1/1996 | McNamara et al. | 439/608 |
| 5,507,655 | 4/1996 | Goerlich | 439/108 |
| 5,547,385 | 8/1996 | Spangler | 439/101 |
| 5,588,851 | 12/1996 | Morlion et al. | 439/108 |
| 5,605,476 | 2/1997 | McNamara et al. | 439/608 |
| 5,607,326 | 3/1997 | McNamara et al. | 439/608 |
| 5,620,340 | 4/1997 | Andrews | 439/608 |
| 5,660,551 | 8/1997 | Sakurai | 439/108 |
| 5,664,968 | 9/1997 | Mickievicz | 439/608 |
| 5,672,084 | 9/1997 | Feldman | 439/852 |
| 5,716,237 | 2/1998 | Conorich et al. | 439/660 |
| 5,775,947 | 7/1998 | Suzuki et al. | 439/608 |
| 5,795,191 | 8/1998 | Preputnick et al. | 439/608 |
| 5,842,872 | 12/1998 | Hosler, Sr. et al. | 439/63 |
| 5,911,603 | 6/1999 | Mansutti | 439/748 |

*Primary Examiner*—Neil Abrams
*Assistant Examiner*—Hae Moon Hyeon
*Attorney, Agent, or Firm*—Woodcock Washburn Kurtz Mackiewicz & Norris LLP

[57] ABSTRACT

A connector system having a header connector and a receptacle connector. The header connector has an array of pins. The modular receptacle connector comprises a ground receptacle contact that contacts adjacent mating surfaces of a pin, and a signal receptacle contact for engaging another pin. The ground and signal receptacle contacts engage respective pins to produce an unbalanced force. The unbalanced force is offset by another unbalanced force produced by neighboring contacts to provide a balanced connector system.

17 Claims, 20 Drawing Sheets

CONNECTOR FOR ELECTRICAL ISOLATION IN A CONDENSED AREA

RELATED APPLICATIONS

This application is related to U.S. patent application Ser. No. 08/942,084, filed Oct. 1, 1997, and U.S. patent application Ser. No. 09/045,660, filed Mar. 20, 1998, both of which are hereby incorporated by reference.

FIELD OF THE INVENTION

The present invention relates in general to electrical connectors. More particularly, the present invention relates to electrical connectors having densely packed contact members capable of passing signals without crosstalk between adjacent contact members.

BACKGROUND OF THE INVENTION

In electronic equipment, there is a need for electrical connectors providing connections in signal paths, and often the signal paths are so closely spaced that difficulties arise from interference between signals being transmitted along adjacent paths.

In order to minimize such difficulties it is known to provide grounding connections in such connectors, such connections serving in effect to filter out undesired interference between signal paths.

However, mere grounding is not always sufficient, and this is particularly so in connectors in which contacts constituting the signal paths through the connector extend through sharp angles, because interference between adjacent signal paths is a particularly large problem in such connectors.

In many situations where electrical signals are being carried among separate subassemblies of complex electrical and electronic devices, reduced size contributes greatly to the usefulness or convenience of the devices or of certain portions of them. To that end, cables including extremely small conductors are now available, and it is practical to manufacture very closely spaced terminal pads accurately located on circuit boards or the like. It is therefore desirable to have a connector of reduced size, to interconnect such cables and circuit boards repeatedly, easily, and reliably, and with a minimum adverse effect on electrical signal transmission in a circuit including such a connector.

In high speed backplane applications, low crosstalk between signal currents passing through the connector is desirable. Additionally, maximizing signal density is also desirable. Low crosstalk insures higher signal integrity. High density increases the number of circuits that can be routed through the connector.

Pin and socket type connectors are typically used to achieve a disconnectable, electrically reliable interface. Moreover, reliability is further increased by providing two redundant, cantilever-type points of contact. Conventional approaches typically locate two receptacle cantilever beams on opposing sides of a projecting pin or blade. This 180° "opposing-beam" method requires a significant amount of engagement clearance in the plane that is defined by the flexing movement of the cantilever beams during engagement. Additionally, due to manufacturing tolerances, end portions of the beams are angled outward from the center lengthwise axis of a mating pin or blade in order to prevent stubbing during initial engagement. This clearance for spring beam flexure and capture projections creates a requirement for contact clearance in the "flexing plane".

This clearance must be accommodated in the connector receptacle housing, thereby becoming a significant limiting factor in improving connector density.

To achieve minimum crosstalk through a coaxial-like isolation of the signal current passing within the connector, isolation in both vertical and horizontal planes alongside the entire connector signal path (including the engagement area) is desired. Clearance requirements in the opposing cantilever beam flexing plane conflicts with requirements for vertical and horizontal electrical isolation while simultaneously maintaining or increasing connector density.

A method for achieving electrical isolation with use of an "L-shaped" ground contact structure is described in a U.S. patent issued to Sakurai (U.S. Pat. No. 5,660,551). Along the length of the receptacle connector, Sakurai creates an L-shape within the cross-section of the ground contact body. In the contact engagement means area, Sakurai transitions to a flat, conventional dual cantilever beam receptacle ground contact and relies on a 90° rotated flat projecting blade, thereby producing an L-shape cross-section when the blade and the receptacle are engaged. This transition of the L-shaped structure in the contact engagement section limits density due to the above described flexing-plane clearance concerns with both the signal and ground dual-beam contacts and also creates an opportunity for producing gap sections where full coaxial-like isolation cannot be maintained. Moreover, in Sakurai, all four cantilever beams flexing planes are oriented in parallel fashion, thereby limiting density.

One conventional method of transmitting data along a transmission line is the common mode method, which is also referred to as single ended. Common mode refers to a transmission mode which transmits a signal level referenced to a voltage level, preferably ground, that is common to other signals in the connector or transmission line. A limitation of common mode signaling is that any noise on the line will be transmitted along with the signal. This common mode noise most often results from instability in the voltage levels of the common reference plane, a phenomenon called ground bounce.

Another conventional method of transmitting data along a transmission line is the differential mode method. Differential mode refers to a method where a signal on one line of voltage V is referenced to a line carrying a complement voltage of −V. Appropriate circuitry subtracts the lines, resulting in an output of V−(−V) or 2V. Any common mode noise is canceled at the differential receiver by the subtraction of the signals.

Implementation of differential pairing in a high speed right angle backplane connectors is typically column-based because shields at ground potential are inserted between the columns of contacts within the connector. In other words, in order to improve signal integrity, conventional products typically use a column-based pair design, such as that found in the VHDM products manufactured by Teradyne, Inc. of Boston, Mass. In column-based pairing, skew is introduced between the true and complement voltages of the differential pair. One of the pair of signals will arrive sooner than the other signal. This difference in arrival time degrades the efficiency of common mode noise rejection in the differential mode and slows the output risetime of the differential signal. Thus, because bandwidth, which is a measure of how much data can be transmitted through a transmission line structure, is inversely related to the length of the risetime by Bandwidth=0.35/Risetime, the amount of the data throughput is degraded by column-based pairing.

Although the art of electrical connectors is well developed, there remain some problems inherent in this technology, particularly densely packing contact members while preventing crosstalk between adjacent contact members. Therefore, a need exists for electrical connectors that have small footprints while maintaining signal integrity.

SUMMARY OF THE INVENTION

The present invention is directed to an electrical connector system, comprising: a header having a plurality of pins; and a socket connector comprising a ground receptacle contact that contacts non-opposing mating surfaces of at least one of the pins, and a signal receptacle contact that contacts another of the pins.

According to further aspects of the invention, the ground receptacle contact has an L-shaped cross-section, each side of the L-shape having a contact point for contacting an associated mating surface of the at least one pin.

According to a further aspect of the invention, the ground receptacle contact and the signal receptacle contact are generally 90 degree offset dual beam contacts.

According to a further aspect of the invention, the signal receptacle contact engages non-opposing sides of a signal pin on the header.

According to a further aspect of the invention, the system further comprises a second ground receptacle contact, the first and second ground receptacle contacts being partially disposed within a module in a differential pair arrangement, the second ground receptacle contact further being partially disposed within an adjacent module, the second ground receptacle contact being disposed in a mirror relationship to the first ground receptacle contact.

According to a further aspect of the invention, wherein the first ground receptacle contact engages the same pin as a second ground receptacle contact of an adjacent module.

According to a further aspect of the invention, wherein the ground and signal receptacle contacts engage respective pins to produce an unbalanced force, the unbalanced force being offset by another unbalanced force produced by neighboring ground and signal receptacle contacts to provide a balanced connector system.

In a further embodiment within the scope of the present invention, a contact for engaging a mating contact is provided and comprises: a mating portion at a first end of the contact for the mating contact, the mating portion having an L-shaped cross-section, each side of the L-shape having a contact point for contacting an associated mating surface of the mating contact; a terminal portion opposite the mating portion; and an intermediate portion extending between the mating portion and the terminal portion.

According to one aspect of the present invention, at least one of the contact points is disposed on a minor surface of the sides. Preferably, another contact point is disposed on a portion cantilevered from another side. More preferably, the cantilevered portion extends beneath a remainder of the side.

In a further embodiment within the scope of the present invention, an electrical interconnection is provided and comprises: a header connector having a first substantially rectangular array of signal pins and a second substantially rectangular array of ground pins, the first and second arrays being offset along a diagonal direction one with respect to the other; a receptacle connector comprising a third substantially rectangular array of signal receptacle contacts arranged to mate with the first array of signal pins and a fourth substantially rectangular array of ground receptacle contacts arranged to mate with the second array of ground pins, the third and fourth arrays being offset and diagonally related one with respect to the other. Preferably, each signal receptacle contact has an L-shaped cross-section, and each ground receptacle contact has an L-shaped cross-section, each side of the L-shape having a contact point for contacting at least two non-opposing mating surfaces of an associated mating surface of an associated ground pin, and one of the sides being generally planar.

The foregoing and other aspects of the present invention will become apparent from the following detailed description of the invention when considered in conjunction with the accompanying drawings.

DESCRIPTION OF EXEMPLARY EMBODIMENTS AND BEST MODE

The present invention is directed to an electrical connector module having a compact profile that provides a coaxial-like electrical isolation of signal connections. The present invention provides signal isolation integrity within a contact engagement region in a minimized size profile by isolating contacts in the horizontal and vertical planes.

Figure 1A:
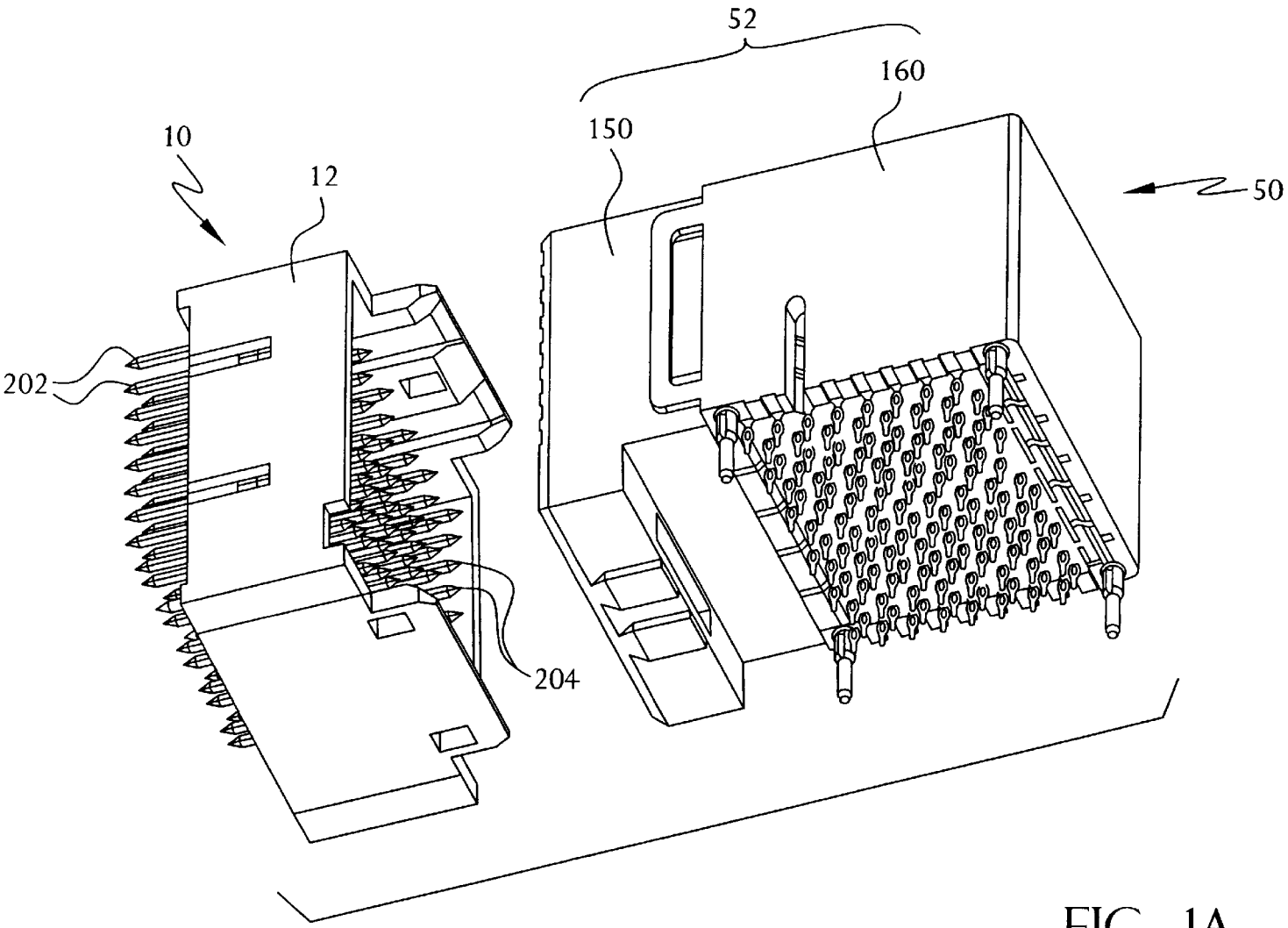
FIGS. 1A and 1B are perspective views of an exemplary connector in accordance with the present invention with the parts unmated and mated, respectively.
Figure 1B:
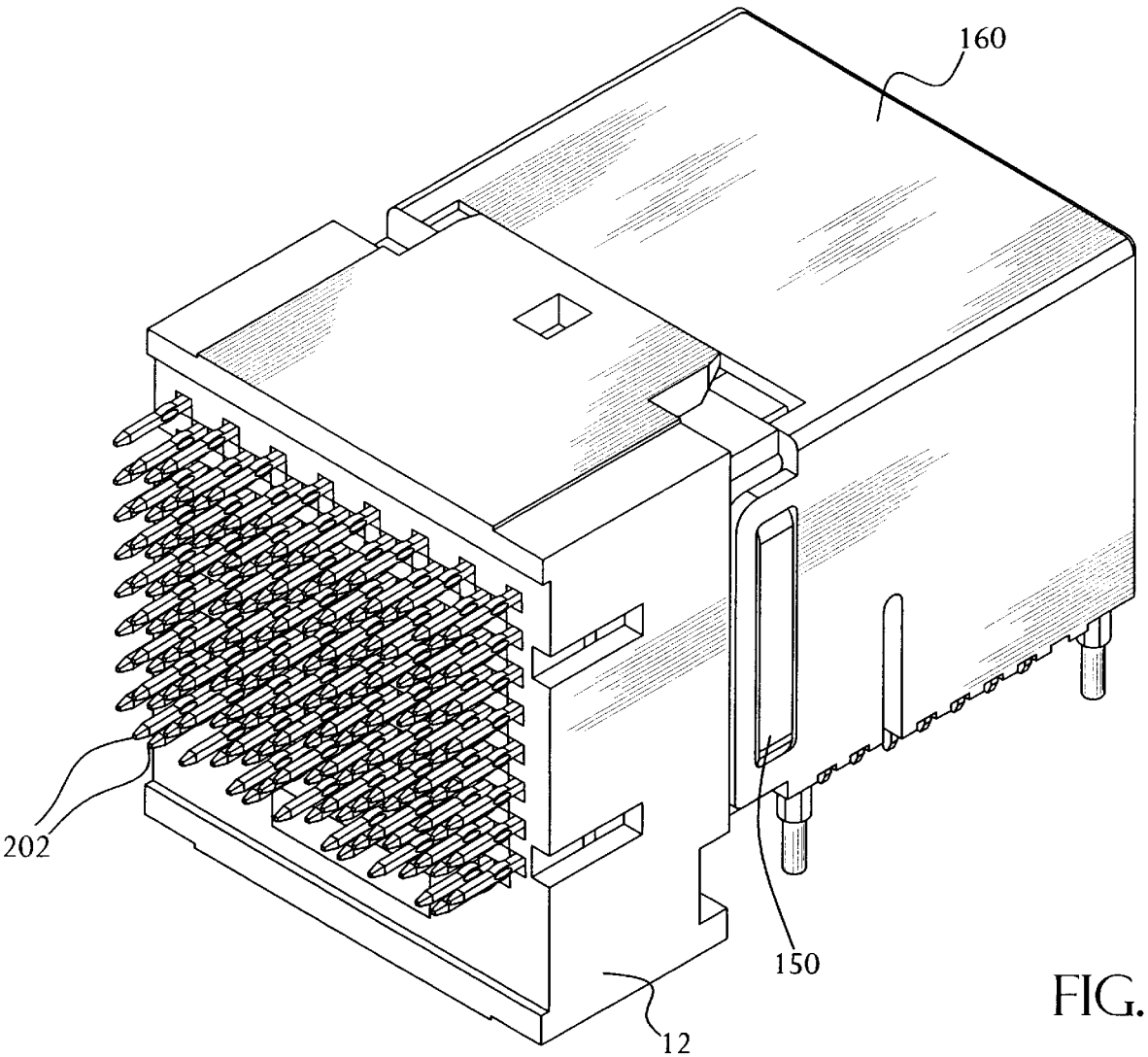
Figure 3:
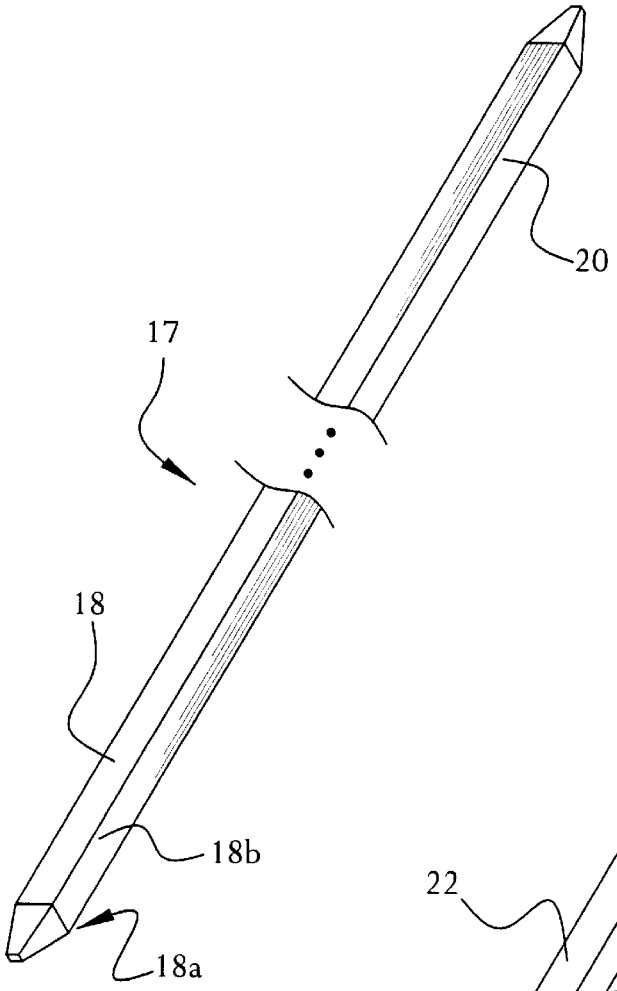
FIG. 3 is a perspective view of an exemplary ground pin in accordance with the present invention.
Figure 4:
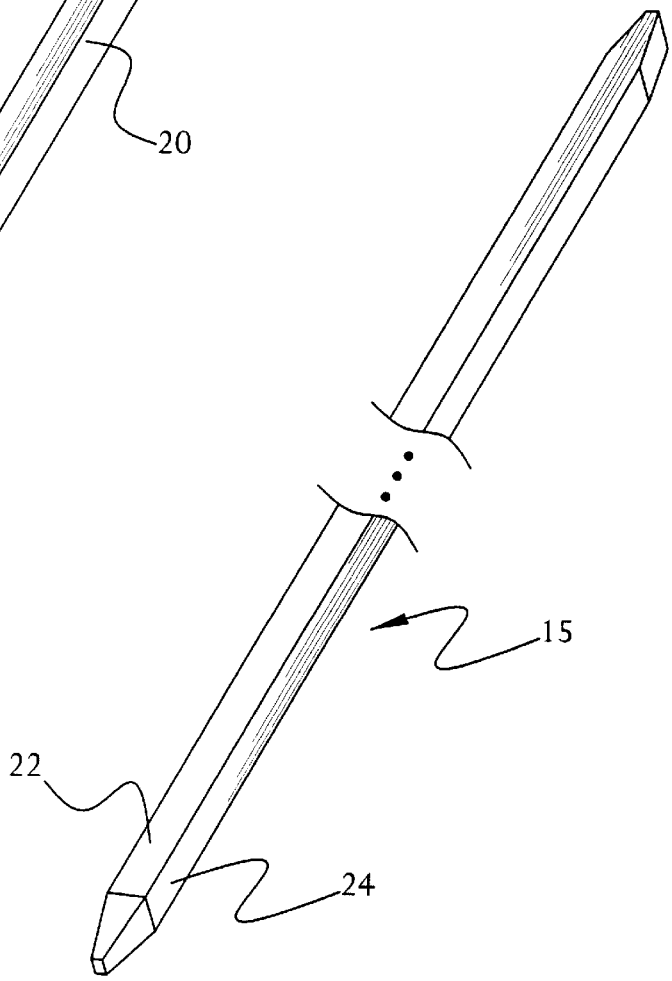
FIG. 4 is a perspective view of an exemplary signal pin in accordance with the present invention.

FIG. 1A is a perspective view of a first embodiment of a high speed transmission connector, with the header and receptacle components separated, according to the present invention. FIG. 1B is a perspective view of the connector of FIG. 1A with the header and receptacle assembled. A straight type of header connector 10 is comprised of a header housing 12 and pins (male contacts) 15 for a signal transmission line and pins (male contacts) 17 for a ground line. These pins 15 and 17, described below with respect to FIGS. 3 and 4, are arranged on the header housing 12 of the associated connector 10 to correspond to the arrangement of ground and receptacle contacts on the receptacle 50. The receptacle 50 preferably comprises socket housings 150, 160 that make up a receptacle housing 52. Each housing is preferably molded, using a plastic material such as a high temperature thermoplastic. The pins 15, 17 are preferably stamped and formed with the preferred material being phosphor bronze or beryllium copper. The header 10 could include suitable shielding. The header connector 10 can be mounted on or connected to a first circuit substrate, such as a motherboard.

Figure 2:
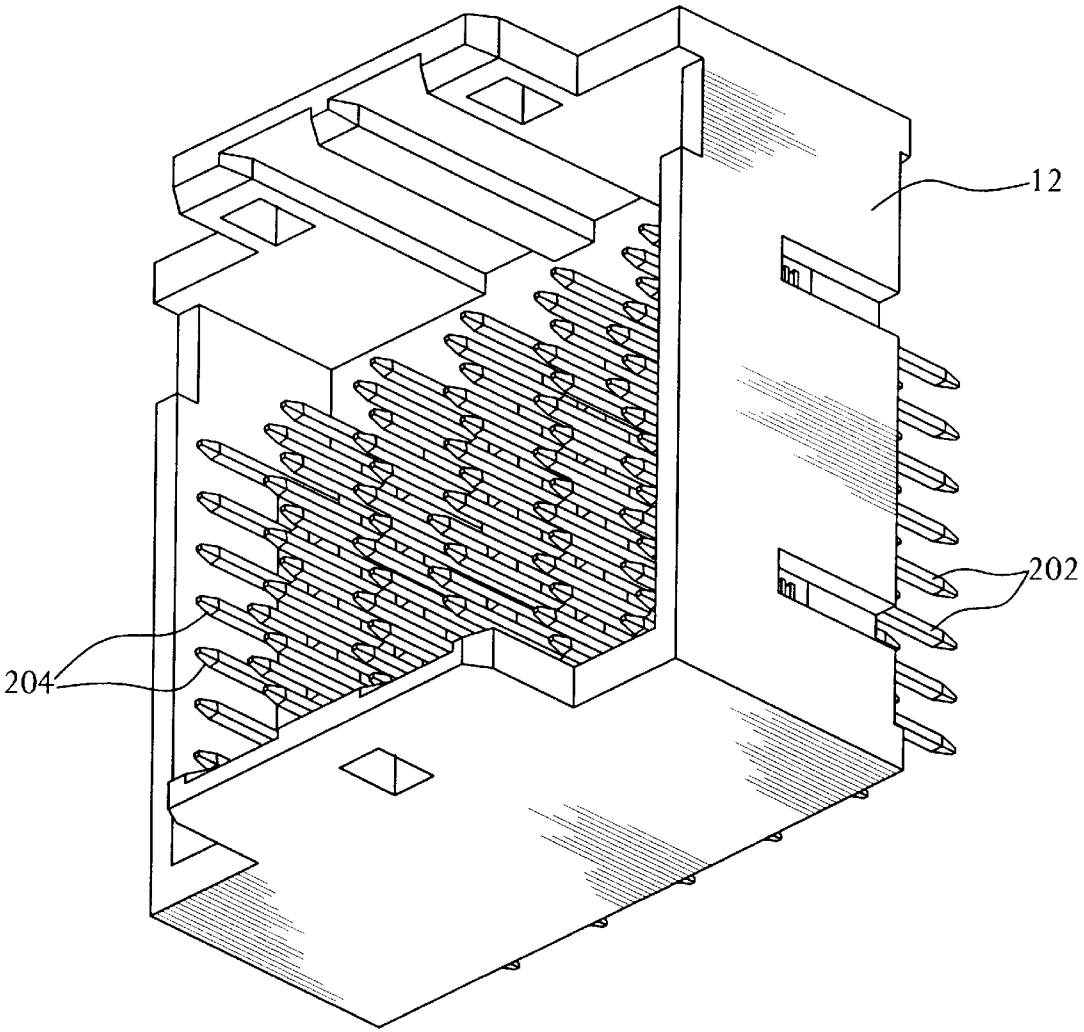
FIG. 2 is a perspective view of an exemplary pin arrangement in a header housing in accordance with the present invention.

FIG. 2 is a perspective view of an exemplary pin arrangement in a header housing 12 in accordance with the present invention. The terminal portions 202 of the signal pins and ground pins extend away from the receptacle connector to engage with a circuit substrate such as a midplane or a backplane. The mating portions 204 of the signal pins and ground pins extend from the housing 12 toward, and ultimately into, the receptacle connector 50. A more detailed description of the header assembly is not necessary for an understanding of the present invention.

Figure 7A:
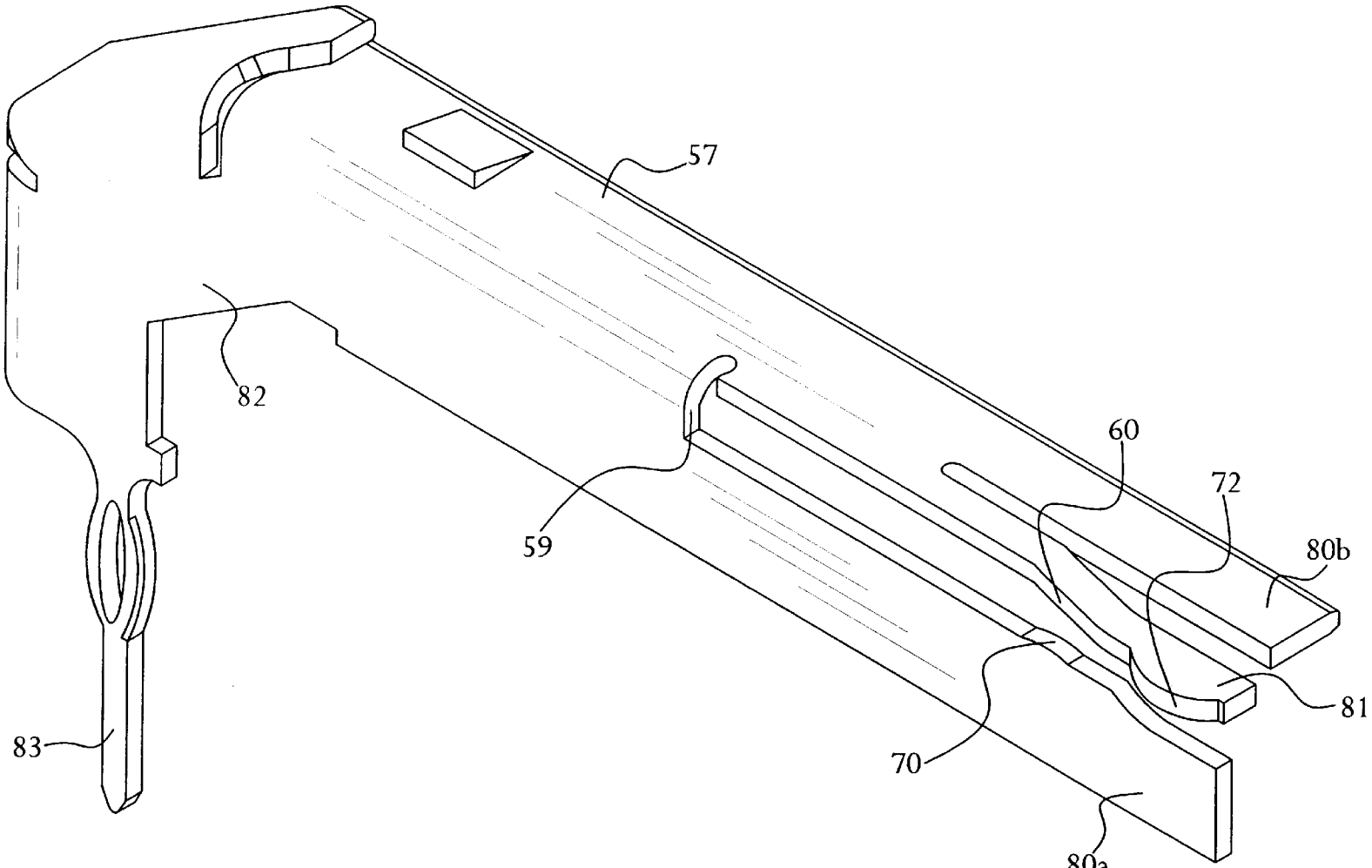
FIGS. 7A, 7B, and 7C are perspective views of an exemplary ground receptacle contact in accordance with the present invention.

FIG. 3 is a perspective view of a portion of an exemplary ground pin in accordance with the invention. The ground pin 17 preferably comprises a mating beam 18 having coined mating surfaces 18*a*, 18*b*. Adjacent faces 18*a*, 18*b* (18*a* is the bottom face) of the mating beam 18 contact a ground receptacle contact (at contact points 70 and 72 as shown in FIG. 7A). The mating beam 18 extends from the base of the header connector (element 10 in FIG. 1). The ground pin 17 also has a tail section (see FIG. 1B) that extends out of the header housing opposite the receptacle housing, into, for example, a printed circuit board.

FIG. 4 is a perspective view of an exemplary signal pin in accordance with the present invention. The signal pin 15 is also provided on the base of the header connector. As with pins 17, pins 15 have adjacent mating surfaces 22, 24.

Header 10 mates with receptacle connector 50. Connector 50 can mount to a second circuit substrate, such as a daughterboard. Header 10 and receptacle 50 interconnect the motherboard and the daughterboard.

Receptacle 50 is a modular connector, formed by a series of modules 101 arranged side-by-side. A lead-in housing 150 and a second housing 160 engage the modules 101, and each other, to form receptacle 50.

Figure 5A:
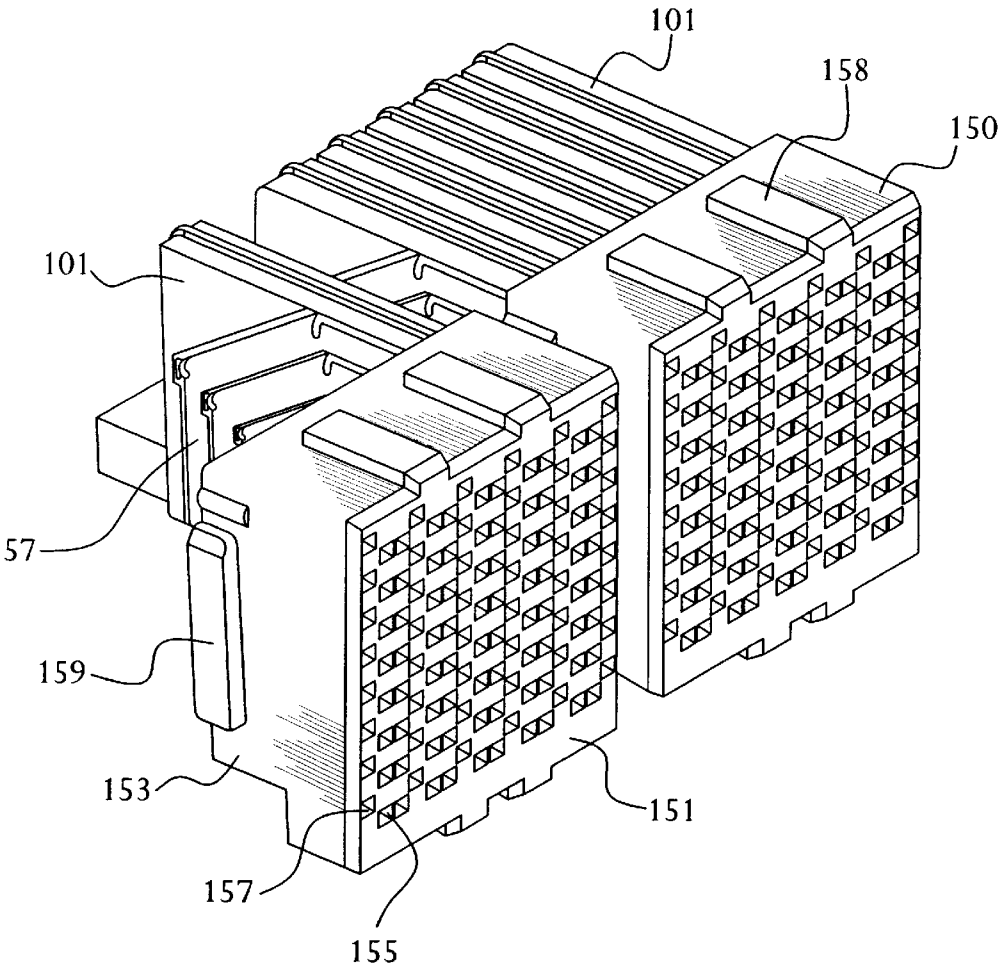
FIG. 5A is a perspective view of a rows of contacts inserted into a housing in accordance with the present invention.
Figure 5B:
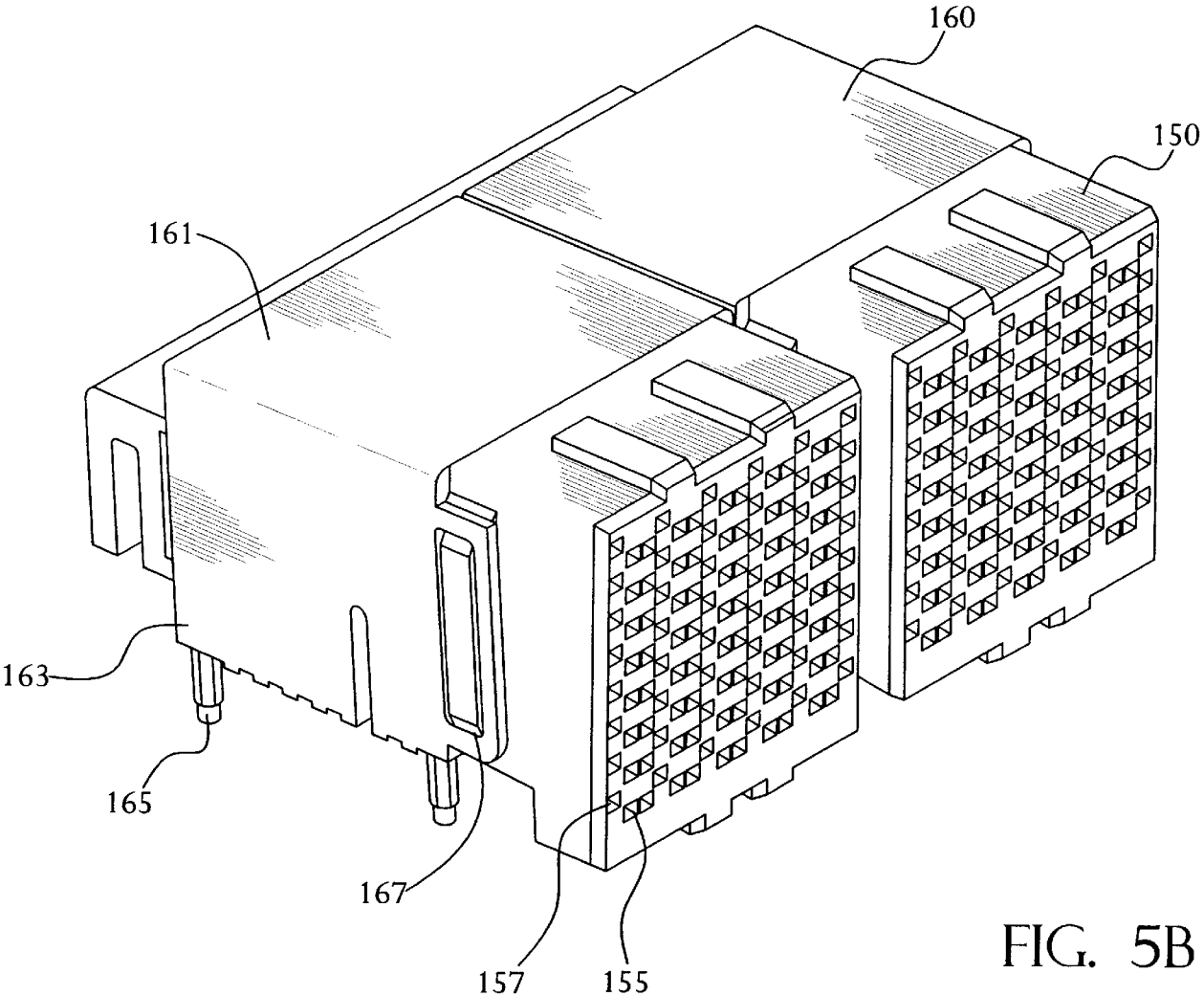
FIG. 5B is a perspective view of the contacts of FIG. 5A inserted into a further housing in accordance with the present invention.

FIG. 5A is a perspective view of the rows of modules inserted into a receptacle housing 150 by the engagement of corresponding features (such as a projection and slot). FIG. 5B is a perspective view of two receptacles 50 placed side-by-side. Each receptacle 50 can have a front housing 150 and a rear housing 160. The socket receptacle housings 150, 160 are preferably comprised of plastic.

Housing 150 has a front face 151 and sidewalls 153 extending from the edges of front face 151. Front face 151 and walls 153 form an open interior in which the front portions of modules 101 reside. A surface of one wall 153 facing the open interior can include grooves (not shown) that receives spines 111 on modules 101 for alignment.

Front face 151 has an array of lead-in apertures 155, 157 that correspond to the arrangement of pins 15, 17 of header 10 and to the arrangement of contacts 55, 57 in modules 101. Housing 150 can have projections 158 on walls 153 that enter alignment grooves (see FIG. 2) in header 10 during insertion. Housing 150 can also have blocks 159 on walls 153 to engage latching structure (see FIG. 1A) on housing 160.

Housing 160 is generally U-shaped, having a top wall 161 and sidewalls 163. The underside of top wall 161 can include grooves (not shown) to receive the spines 111 of modules 101. Sidewalls 163 have posts 165 for mounting to the daughterboard and a latch 167 for securing to housing 150. Once secured to housing 150, housing 160 retains modules 101 between the housings 150, 160 to form receptacle 50.

Modules 101 will now be described. Each module 101 includes a front housing 100, rear housing 110, signal contacts 55, and ground contacts 57.

Figure 6A:
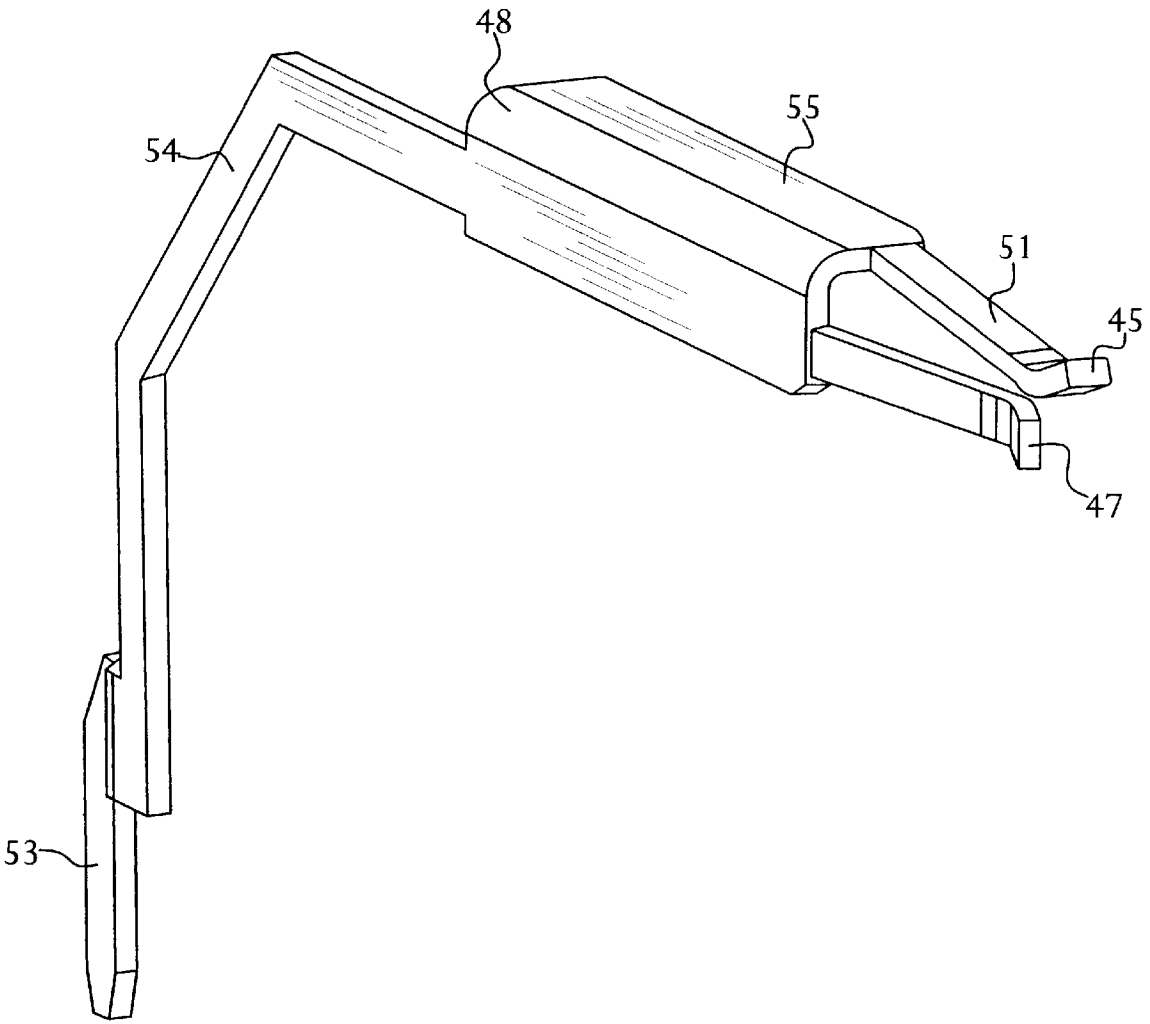
FIGS. 6A and 6B are perspective views of an exemplary signal receptacle contact in accordance with the present invention.
Figure 6B:
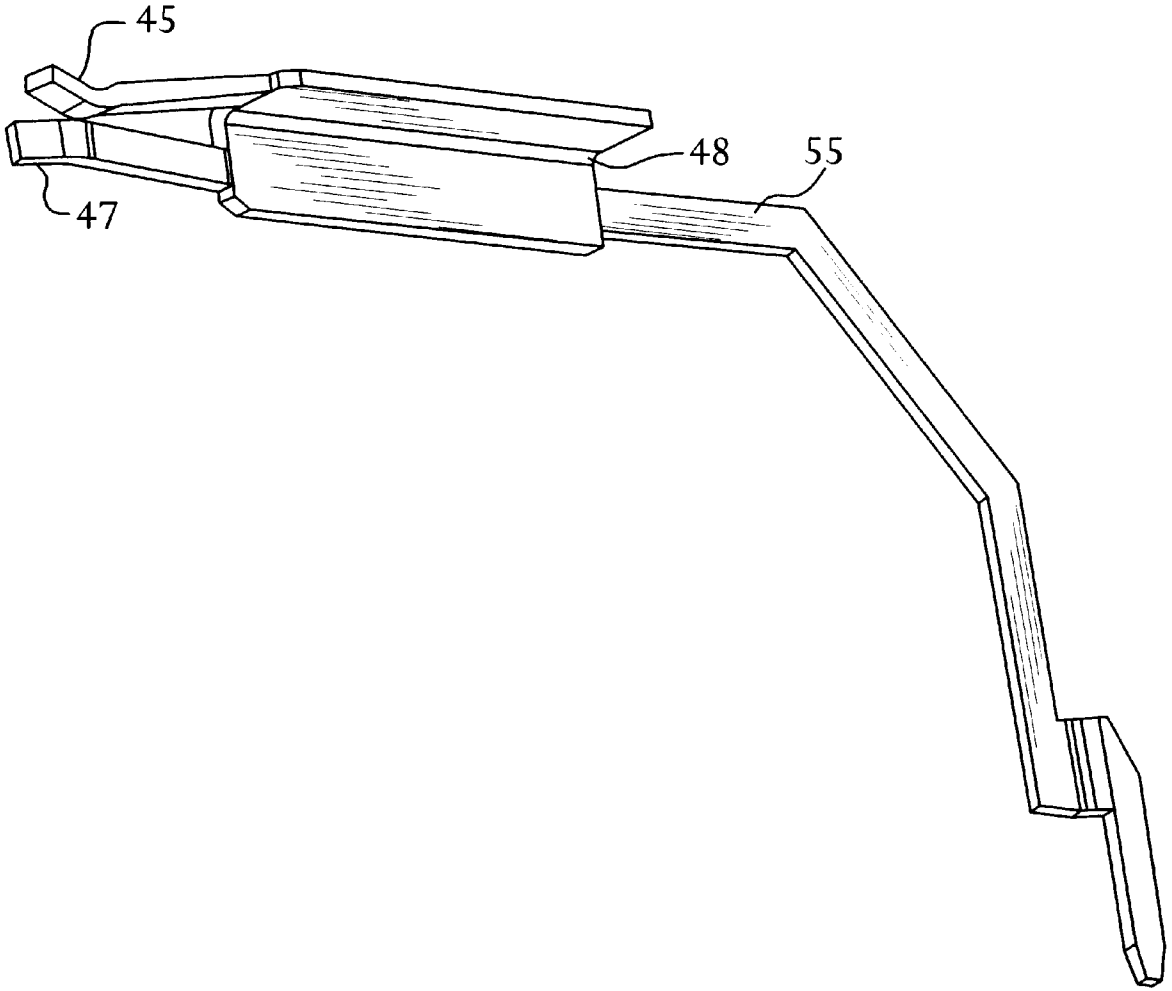

FIGS. 6A and 6B are perspective views of an exemplary signal receptacle contact in accordance with the present invention. Most preferably, contact 55 has an L-shaped structure 48 that engages non-opposing surfaces, specifically adjacent surfaces 22, 24 of pin 15. The front end of L-shaped portion 48 has a pair of arms 51 extending therefrom. Arms 51 have flared ends 45,47, providing surfaces to mate with the associated pin of the header connector. Major surfaces of arms 51 engage pins 15. The intermediate portion 54 of contact 55 has a square sectional shape. The securing or rear end portion of contact 55 has an angled terminal for mounting to a PCB thereof, with a terminal 53, respectively.

Figure 7B:
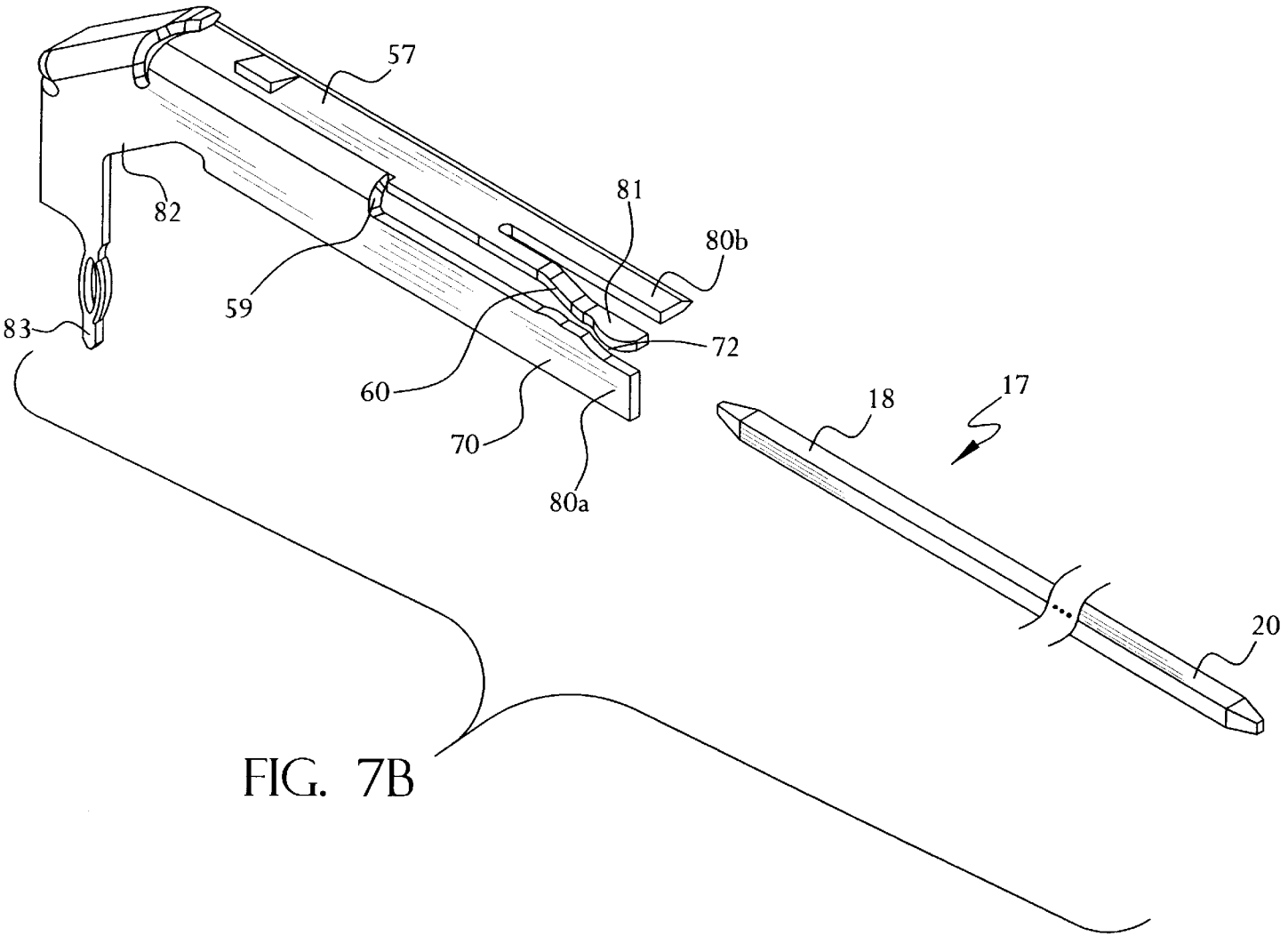
Figure 7C:
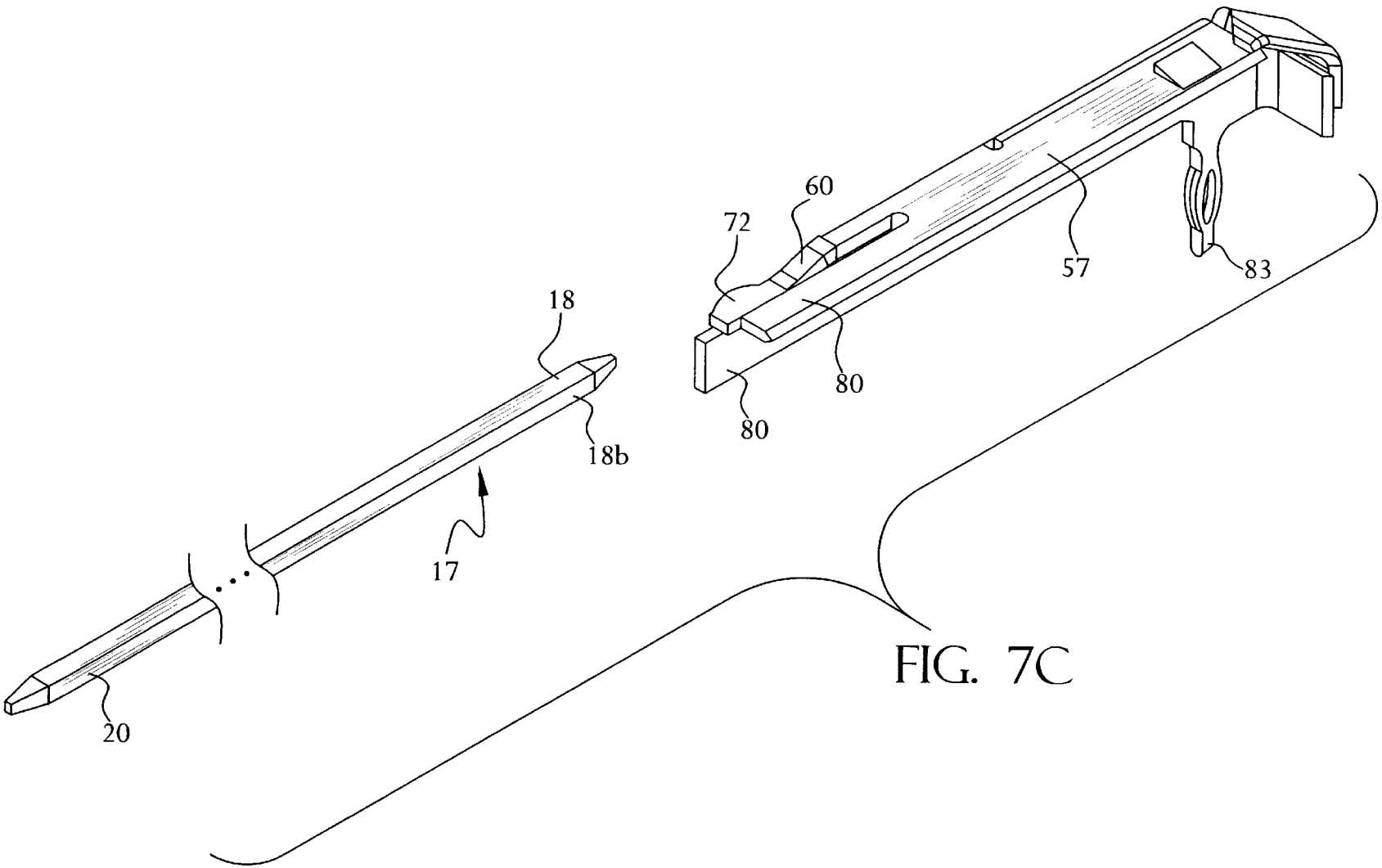

FIGS. 7A, 7B, and 7C are perspective views of an exemplary ground receptacle contact in accordance with the present invention. The ground receptacle contact 57 engages two non-opposed surfaces of ground pin 17. Preferably, contact 57 has an L-shape to receive a pin (e.g., the ground pin 17) on two adjacent (or non-opposing) mating surfaces 18*a* and 18*b* of the mating beam 18. Each portion of the "L" shape has a shielding tab 80*a*, 80*b* to provide electromagnetic shielding. Tab 80*a* has a contact point 70 that engages pin 17. Preferably, contact point 70 is located on a minor surface of tab 80*a*. Tab 80*b* has a contact point 72 on a portion 81 cantilevered from the remainder of tab 80. As with tab 80*a*, contact point 72 resides on a minor surface of tab 80*b*. An intermediate portion of contact 57 has an angled portion 82. The securing or rear end portion of contact 57 has a terminal 83 for mounting to the board.

As seen in FIGS. 7B and 7C, portion 81 extends beneath the remainder of tab 80*b*. Portion 81 is bent downwardly from the remainder of tab 80*b* to align contact point 72 with pin 17. Upon insertion of pin 17, portion 81 can flex laterally towards the remainder of tab 80*b*. Clearly FIG. 7B demonstrates that contact 57 engages non-opposing sides of pin 17.

Figure 8A:
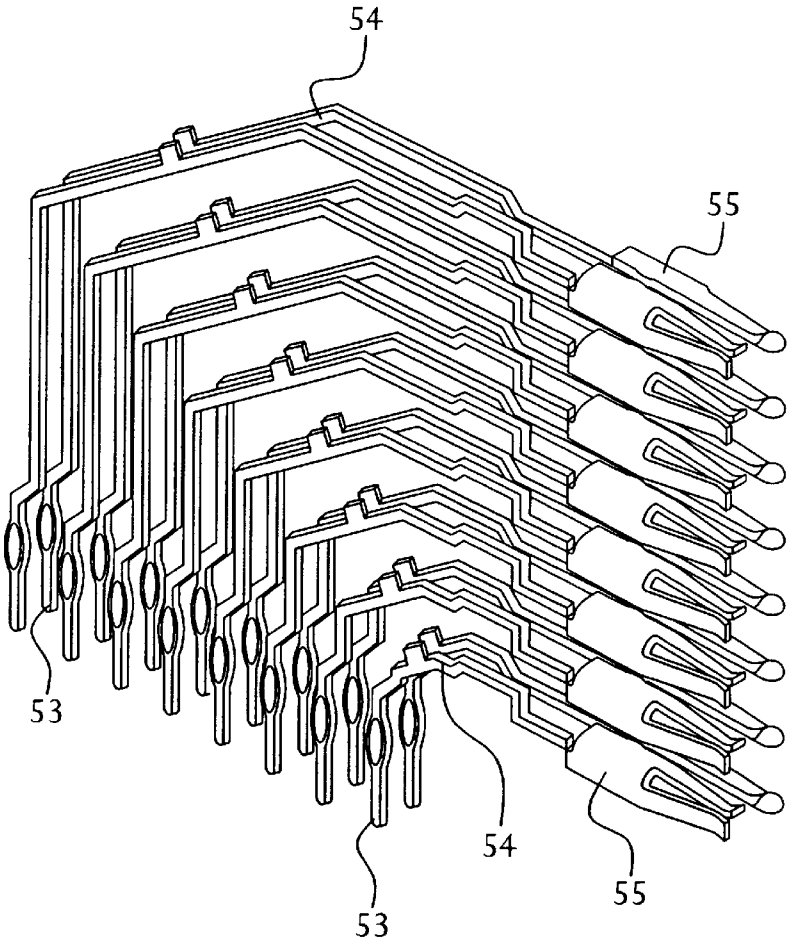
FIG. 8A is a perspective view of a pair of rows of exemplary signal receptacle contacts in accordance with the present invention.

The assembly of modules 101 will now be described. FIG. 8A is a perspective view of a pair of rows of exemplary signal receptacle contacts in accordance with the present invention. In this differential pair arrangement, adjacent columns are generally mirror images of each other. Each of the signal receptacle contacts are substantially similar to the contact 55 described with respect to FIG. 6A. The terminal 53 and right angle portions 54 vary in size to appropriately fit in a housing, as described below.

Figure 8B:
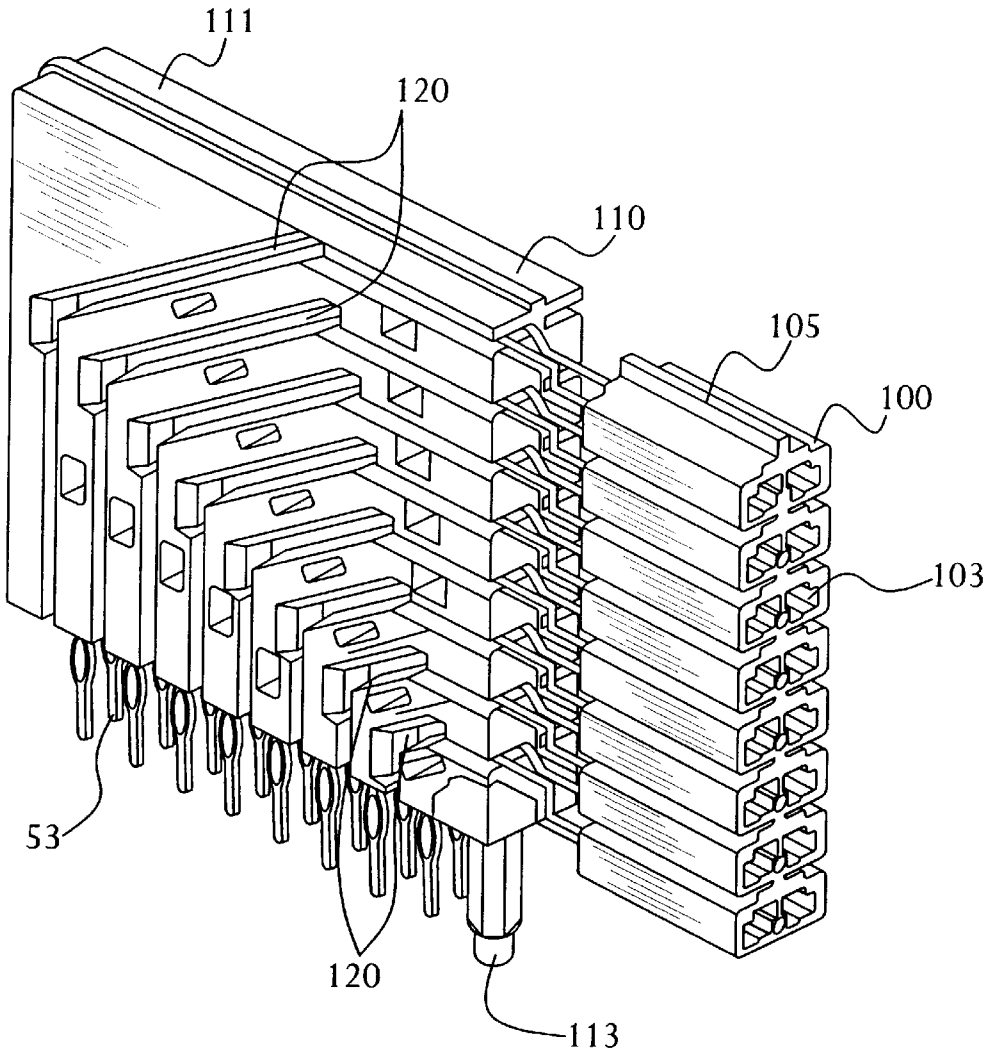
FIG. 8B is a perspective view of the rows of contacts of FIG. 8A with an overmold and an additional housing over the contacts in accordance with the present invention.
Figure 9A:
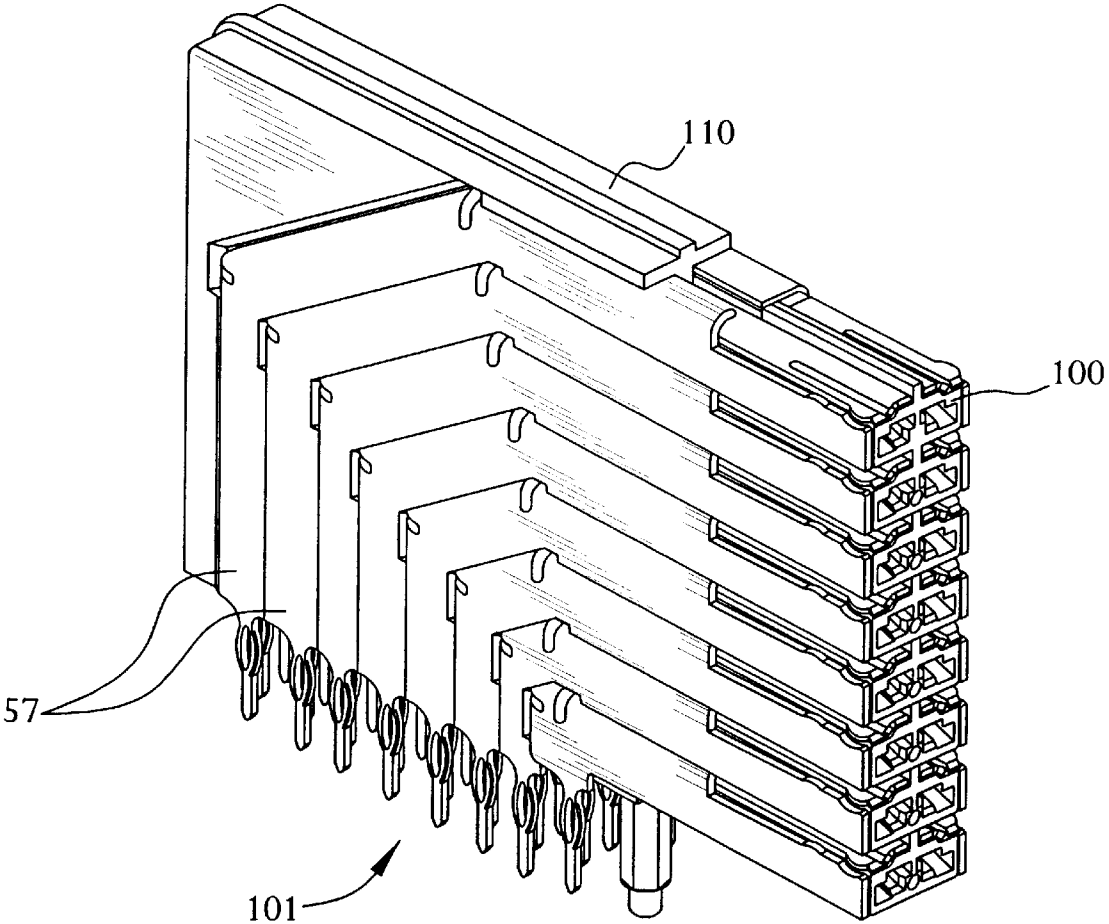
FIG. 9A is a perspective view of the rows of contacts of FIG. 8B with a pair of rows of exemplary ground receptacle contacts in accordance with the present invention.

FIG. 8B is a perspective view of the rows of contacts of FIG. 7A after a housing 110 is overmolded about the intermediate portion 54 and part of the terminal portions 53 of the contacts 55. The housing 110 is preferably molded, using a plastic material such as a high temperature thermoplastic. The housing 110 comprises slots 120 in which ground receptacles 57 are later positioned, as shown in FIG. 9A. The overmold process also creates spine 111 and alignment post 113.

Front housing 100 has openings 103 that receive signal contacts 55 from the rear and pins 15 from the front. Front housing 100 can also have a spine 105 that engages the corresponding groove in housing 150. Front housing 100 is preferably separately molded (i.e., not overmolded around contacts 55) and is used to isolate the signal contacts 55 and pins 15 from each other and from the ground contacts 57 and pins 17. Front housing 100 helps align the modules for insertion into receptacle housing 150 and protects the contacts during shipping. The housing 100 is preferably molded, using a plastic material such as a high temperature thermoplastic. Housings can be placed over contacts 55 before, during, or after the overmold step.

Once housing 110 is overmolded about contacts 55 and housing 100 is placed over contacts 55, ground contacts 57 are placed over housings 100, 110. Corresponding portions of ground contacts 55 are inserted into grooves 120 in housing 110. The front portion of ground contacts 57 surrounds a corresponding portion of housing 100 since they have complementary edges. Housings 100, 110 and contacts 55, 57 combine to form a completed module, as shown in FIG. 9A. Modules, placed side-by-side and inserted into housing 150, form the receptacle connector.

Figure 9B:
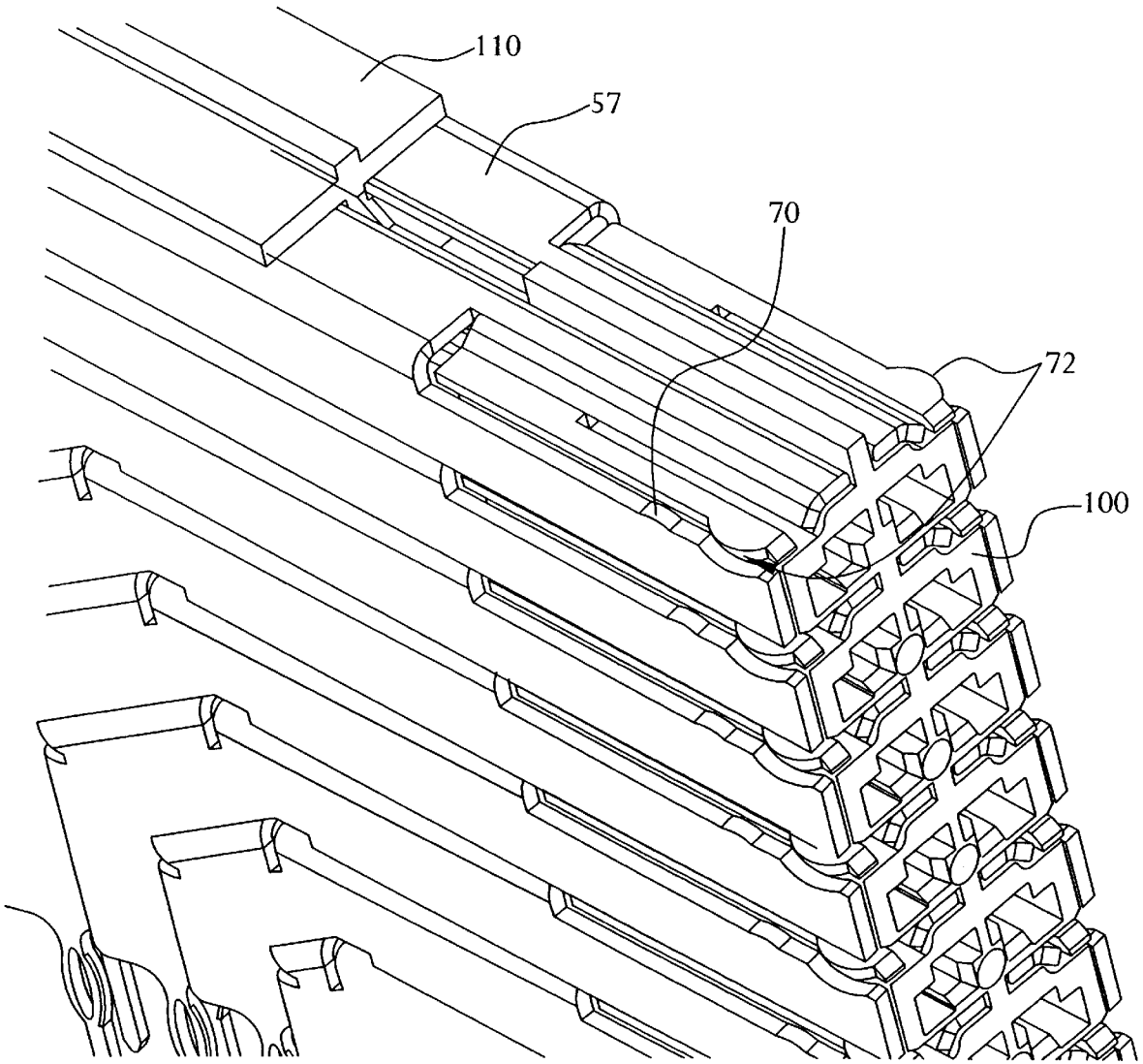
FIG. 9B is a detailed view of the of rows of contacts of FIG. 9A.
Figure 9C:
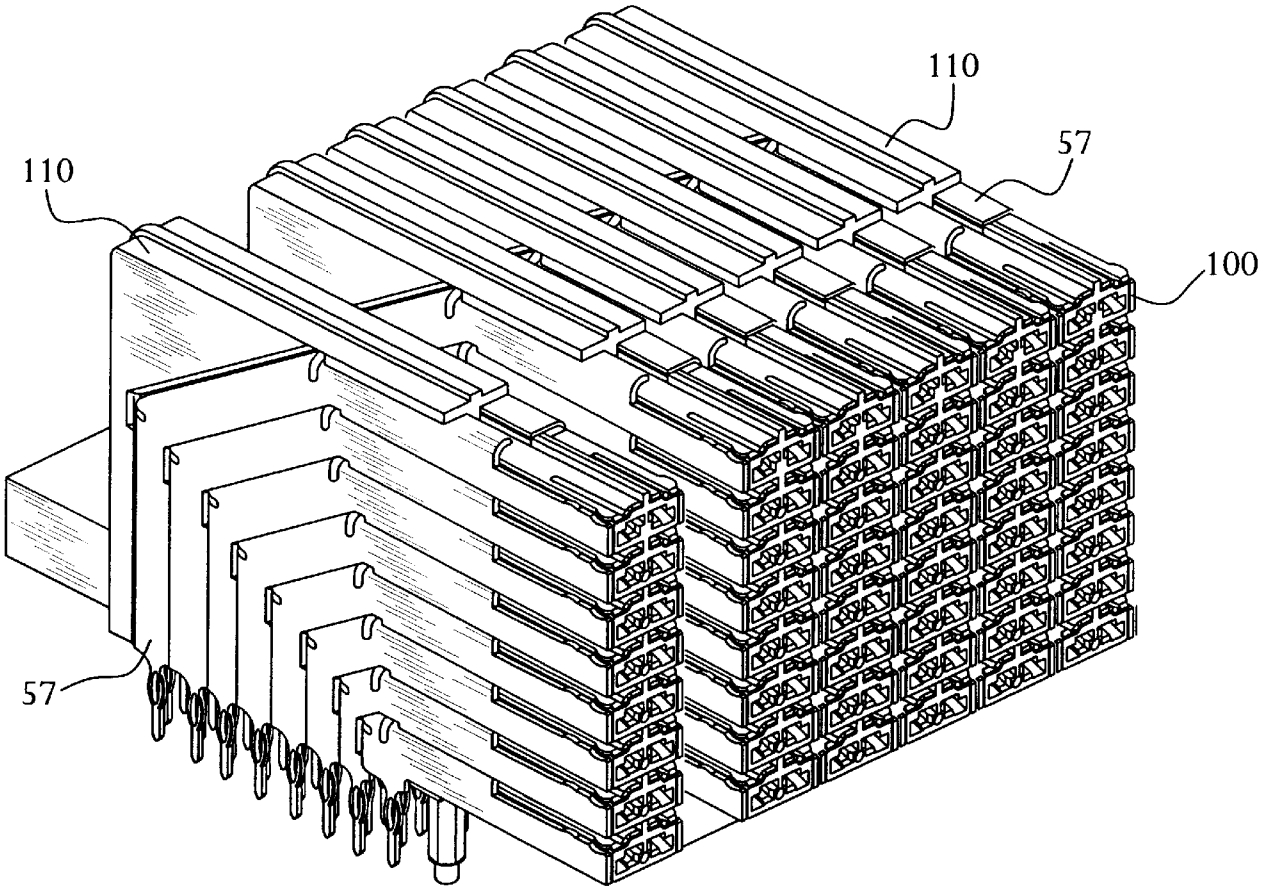
FIG. 9C is a perspective view of additional rows of contacts of FIG. 9A in accordance with the present invention.

FIG. 9B displays a close up of completed module 101. A plurality of rows and columns of the contacts of the connector modules can be regularly arranged in a closely spaced array. The preferable pitch is 2 mm, and preferably a signal contact column is interposed between two adjacently located ground contact columns. Each signal pin 15 is shielded by the ground receptacle contact 57 in its connector module, as well as the ground receptacle contacts 57 in neighboring modules. It should be noted that any number of connector modules can be arrayed. A plurality of pairs of rows of contacts, such as those described with respect to FIG. 9A are positioned next to each other, as shown in FIG. 9C.

Figure 9D:
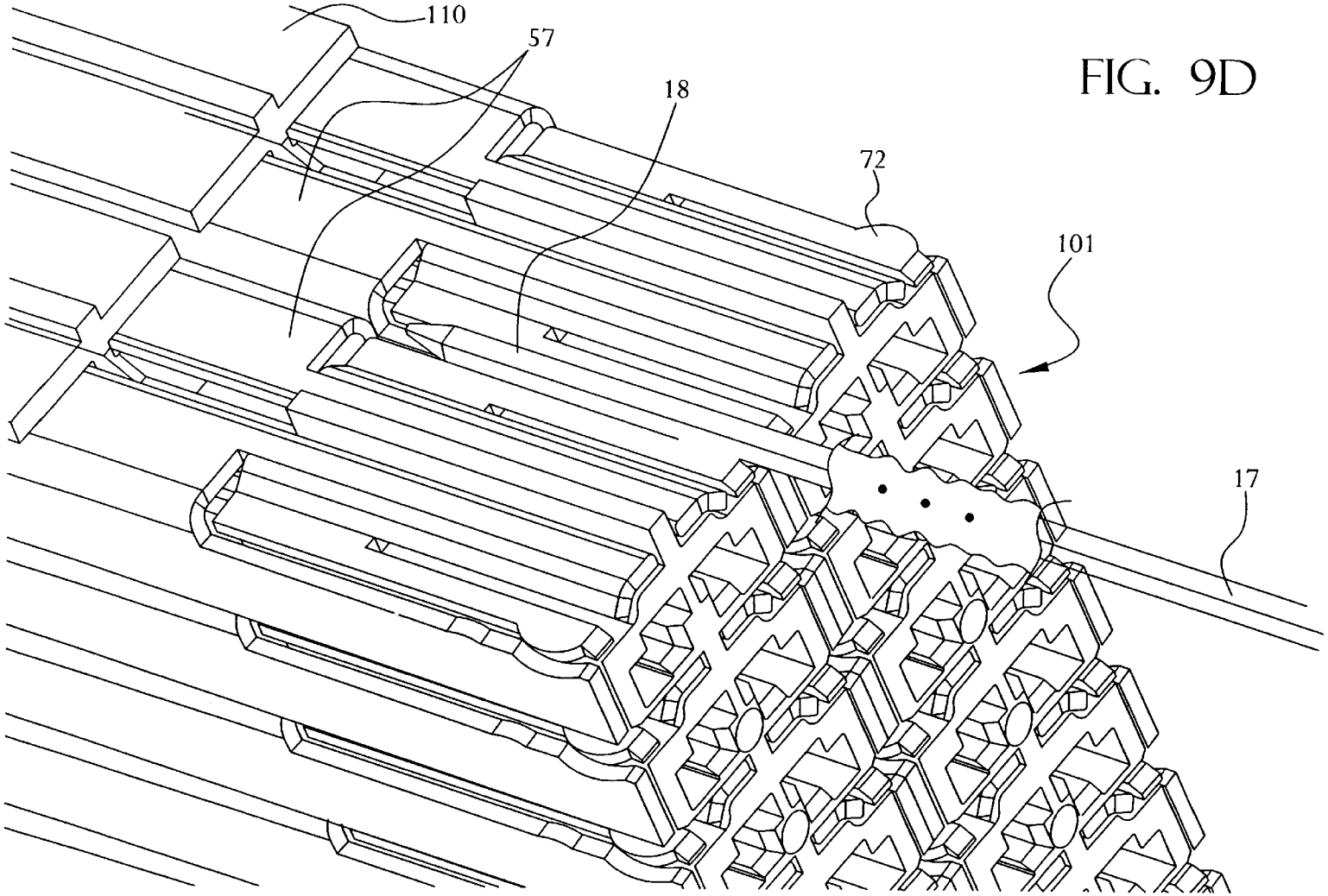
FIG. 9D is a perspective view of pairs of rows of exemplary ground contacts with an associated exemplary ground pin in accordance with the present invention.

FIG. 9D is a perspective view of pairs of rows of exemplary ground contacts 57 of adjacent modules 101 with an associated exemplary ground pin. The pin is similar to the ground pin 17 described with respect to FIG. 3. The mating beam 18 is inserted into the receptacle between two neighboring ground receptacles 57, one each from adjacent modules. The mating beam 18 contacts the receptacles at four places: the contact points 70, 72 on each of the neighboring receptacles. The mating beam 18 contacts each contact at location 72 on opposite sides of the mating beam 18, and each contact at location 70 on the bottom of the mating beam 18.

Figure 9E:
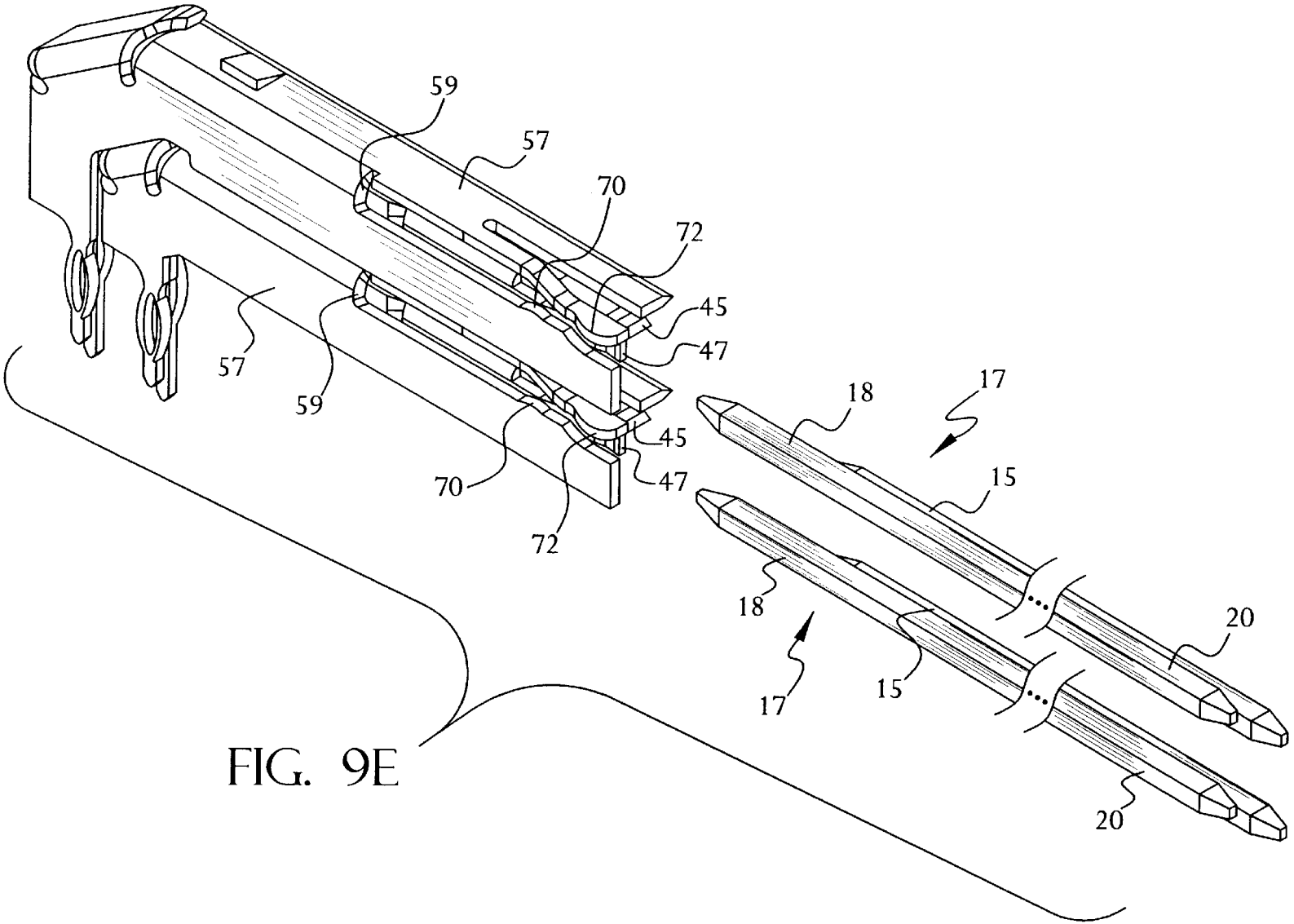
FIGS. 9E and 9F are perspective views of a pair of exemplary socket connectors, each comprising a signal receptacle contact and a ground receptacle contact with associated pins in accordance with the present invention.
Figure 9F:
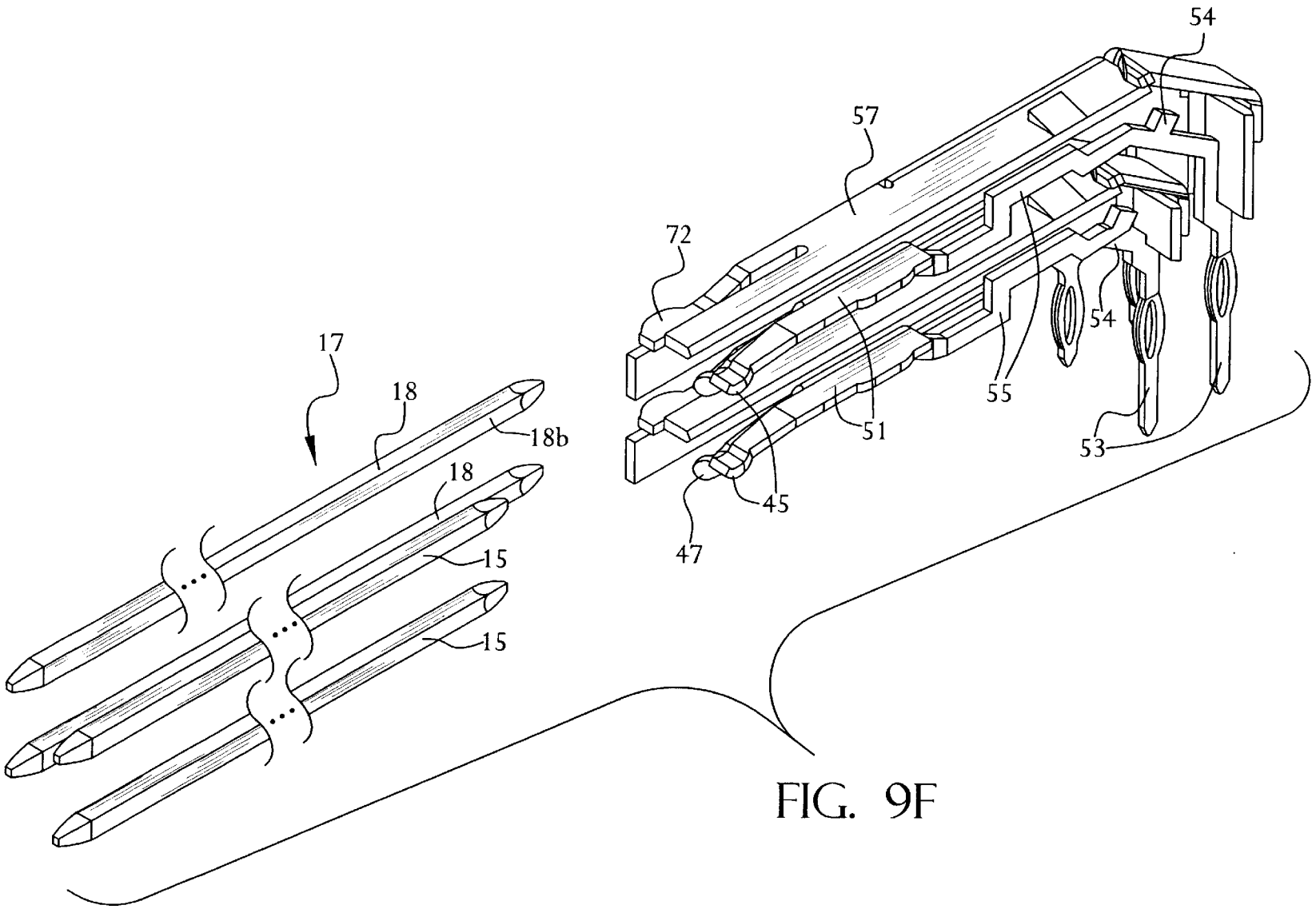

FIGS. 9E and 9F are perspective views of the arrangement of a pair of exemplary socket connector elements (with housings 100, 110 removed for clarity), each comprising a signal receptacle contact and a ground receptacle contact, with associated pins in accordance with the present invention. FIGS. 9E and 9F combine a pair of the signal receptacle contacts 55 of FIGS. 6A and 6B with a pair of the ground receptacle contacts 57 of FIGS. 7A–7C. Also shown are the pins 17 and 15 of FIGS. 3 and 4, respectively.

With respect to the signal receptacle contact 55, the contact points 45 and 47 mate on adjacent (or non-opposing) sides 22 and 24 of the signal pin 15, which preferably has a rectangular cross-section, and not on opposing sides of the signal pin 15. With respect to the ground receptacle contact 57, the contact points 70 and 72 mate on adjacent (or non-opposing) sides 18*a* and 18*b* of the ground pin 17. The mating scheme provides more room to surround the signal with a ground. This gives electrical isolation in a condensed area.

Figure 10:
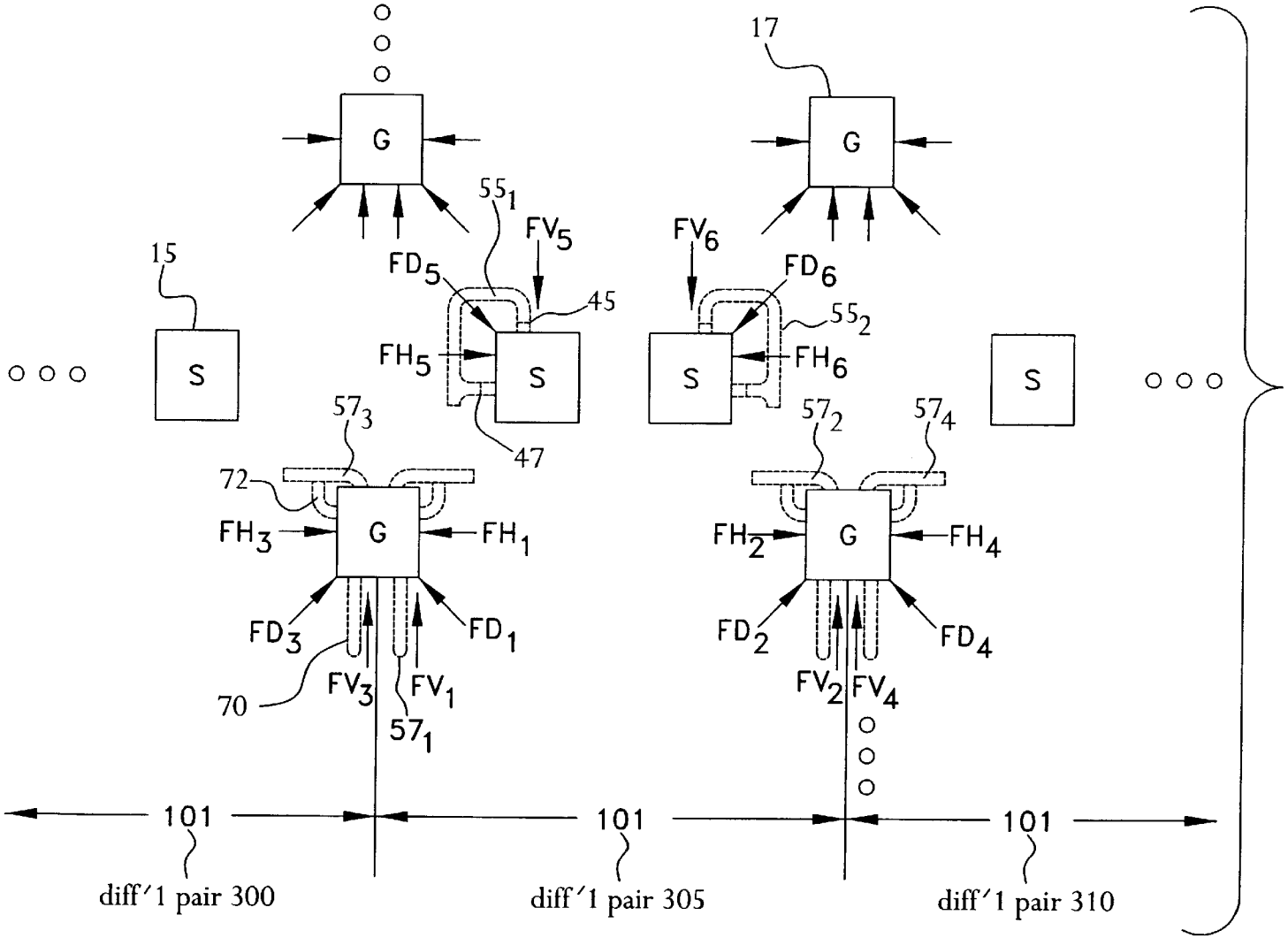
FIG. 10 shows a differential pair arrangement force diagram in accordance with the present invention.

As described in U.S. patent application Ser. No. 08/942,084, filed Oct. 1, 1997, and U.S. patent application Ser. No. 09/045,660, filed Mar. 20, 1998, the connector provides balanced reaction forces. As shown in the differential pair arrangement force diagram of FIG. 10, each differential pair (e.g., differential pair 305) comprises a pair of ground receptacle contacts (e.g., contacts 57, and 572), and a pair of signal receptacle contacts (e.g., contacts $\mathbf{55}_1$ and $\mathbf{55}_2$). With respect to the differential pair 305, each ground contact 57 contacts a ground pin, as described above, thereby generating a sets of forces represented by vectors $FH_1$ and $FH_2$ in the horizontal direction and $FV_1$ and $FV_2$ in the vertical direction. In a neighboring differential pair, for example differential pair 300, the ground contact $\mathbf{57}_3$ contacts the ground pin which is also engaged by the adjacent contact 57, in a neighboring module 101. Contact $\mathbf{57}_3$ generates a set of forces represented by vector $FH_3$ and $FV_3$, in the horizontal and vertical directions, respectively. Similarly, in neighboring differential pair 310, the ground contact $\mathbf{57}_2$ contacts the ground pin which is also engaged by the adjacent contact $\mathbf{57}_2$ in a neighboring module 101. Contact $\mathbf{57}_4$ generates a set of forces represented by vector $FH_4$ and $FV_4$, in the horizontal and vertical directions, respectively. The forces act on the connector module to create resultant forces represented by vectors $FD_1$, $FD_2$, $FD_3$, and $FD_4$, in resultant directions, preferably diagonal to the associated ground contacts.

Other forces are developed by the signal receptacle contacts (e.g., contacts $\mathbf{55}_1$ and $\mathbf{55}_2$ in differential pair 305) on the signal pins, thereby generating a sets of forces represented by, with respect to differential pair 305, $FH_5$ and $FH_6$ in the horizontal directions and $FV_5$ and $FV_6$ in the vertical directions. These forces act on the connector module to create resultant forces represented by vectors $FD_5$ and $FD_6$ in resultant directions, preferably diagonal to the associated signal contacts.

Preferably, with respect to differential pair 305, the vectors $FD_1$ and $FD_5$ are in opposite, diagonal directions, and they have equal magnitude, as preferably do vectors $FD_2$ and $FD_6$, thus offsetting each other and ultimately balancing the connector. Thus, the present invention balances forces using the ground and signal contacts in conjunction with the ground and signal pins in differential pairs. Similar vector balancing occurs in the other differential pairs of the connector.

The present invention allows implementation of full electrical isolation within the contact engagement zone in a more compact fashion. Moreover, the present invention maintains full isolation in the diagonal direction.

It should be noted that although the ground pins and signal pins of the illustrated embodiments are provided with an approximately square cross-section, the present invention is not limited thereto. The use of other shapes, such as rectangular and round, is also contemplated.

It should be noted that although the socket connector of the illustrated embodiment is provided with right angle portion, the present invention is not limited thereto. For example, the present invention can be applied to a socket connector (not shown) having a straight type ground contact and a straight type signal contact, without a right angle portion.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. An electrical connector system, comprising:

a socket connector comprising a ground receptacle contact that contacts non-opposing mating surfaces of at least one of a plurality of pins of a mating connector, and a signal receptacle contact that contacts another of said pins, wherein said ground and signal receptacle contacts engage respective pins to produce an unbalanced force, said unbalanced force being offset by another unbalanced force produced by neighboring contacts to provide a balanced connector system.

2. The connector system of claim 1, wherein said ground receptacle contact has an L-shaped cross-section, each side of the L-shape having a contact point for contacting an associated mating surface of said at least one of said pins.

3. The connector system of claim 1, wherein said ground receptacle contact and said signal receptacle contact each have dual beams that are generally 90 degree offset.

4. The connector system of claim 1, wherein said signal receptacle contact engages non-opposing sides of said another of said pins.

5. The connector system of claim 1, further comprising a second ground receptacle contact, said first and second ground receptacle contacts being partially disposed within a module in a differential pair arrangement, said second ground receptacle contact further being associated with an adjacent module, said second ground receptacle contact being disposed generally in a mirror relationship to said first ground receptacle contact.

6. The connector system of claim 5, wherein said first ground receptacle contact engages the same pin as a second ground receptacle contact of an adjacent module.

7. The connector system of claim 1, further comprising a header that includes said plurality of pins.

8. A contact for engaging a mating contact, comprising:

a mating portion at a first end of the contact for engaging the mating contact, said mating portion having an L-shaped cross-section, each side of the L-shape having a contact point for contacting an associated mating surface of the mating contact, the contact having only a single mating portion for engaging the mating contact;

a terminal portion opposite said mating portion; and an intermediate portion extending between said mating portion and said terminal portion.

9. The contact of claim 8, wherein at least one of said contact points is disposed on a minor surface of said sides.

10. The contact of claim 9, wherein another of said contact points is disposed on a portion cantilevered from another of said sides.

11. The contact of claim 10, wherein said cantilevered portion extends beneath a remainder of said side.

12. The contact of claim 8, wherein both contact points are disposed on minor surfaces of said sides.

13. An electrical interconnection comprising:

a receptacle connector comprising a first substantially rectangular array of signal receptacle contacts arranged to mate with a first array of signal pins of a mating connector and a second substantially rectangular array of ground receptacle contacts arranged to mate with a second array of ground pins of the mating connector, said first and second arrays being offset and diagonally related one with respect to the other;

each signal receptacle contact having a mating section with an L-shaped cross-section; and each ground receptacle contact having a mating section with an L-shaped cross-section, each side of the L-shape having a contact point for contacting at least two adjacent mating surfaces of an associated mating surface of an associated ground pin, and one of said sides being generally planar.

14. The interconnection of claim 13, further comprising a header connector having a third substantially rectangular array of signal pins and a fourth substantially rectangular array of ground pins, said third and fourth arrays being offset along a diagonal direction one with respect to the other.

15. An electrical connector system, comprising:

a socket connector comprising a ground receptacle contact that contacts non-opposing mating surfaces of at least one of a plurality of pins, and a signal receptacle contact that contacts another of said pins; and a second ground receptacle contact, said first and second ground receptacle contacts being partially disposed within a module in a differential pair arrangement, said second ground receptacle contact further being associated with an adjacent module, said second ground receptacle contact being disposed generally in a mirror relationship to said first ground receptacle contact.

16. A contact for engaging a mating contact, comprising:

a mating portion at a first end of the contact for engaging the mating contact and providing an unbalanced force to the mating contact, said mating portion having an L-shaped cross-section, each side of the L-shape having a contact point for contacting an associated mating surface of the mating contact;

a terminal portion opposite said mating portion; and an intermediate portion extending between said mating portion and said terminal portion.

17. A contact for engaging a mating contact, comprising:

a mating portion at a first end of the contact for engaging the mating contact, said mating portion having an L-shaped cross-section, each side of the L-shape having a contact point for contacting an associated mating surface of the mating contact, wherein at least one of said contact points is disposed on a minor surface of said sides;

a terminal portion opposite said mating portion; and an intermediate portion extending between said mating portion and said terminal portion.

* * * * *